US007699664B2

(12) United States Patent
Kim et al.

(10) Patent No.: US 7,699,664 B2
(45) Date of Patent: Apr. 20, 2010

(54) MULTIPURPOSE ACCESSORY FOR PORTABLE MULTIMEDIA DEVICE

(75) Inventors: Jin-Seok Kim, Seoul (KR); Han-Ho Maeng, Seoul (KR); Young-Woong Han, Seoul (KR); Myung-Hoon Jung, Yongin (KR)

(73) Assignee: Yungs Group, Inc., Yoksam-dong, Kangnam-gu, Seoul (KR)

( * ) Notice: Subject to any disclaimer, the term of this patent is extended or adjusted under 35 U.S.C. 154(b) by 52 days.

(21) Appl. No.: 11/842,404

(22) Filed: Aug. 21, 2007

(65) Prior Publication Data

US 2008/0188124 A1 Aug. 7, 2008

(30) Foreign Application Priority Data

Feb. 7, 2007 (KR) ..... 10-2007-0012421

(51) Int. Cl.
*H01R 24/04* (2006.01)

(52) U.S. Cl. ..... 439/668; 439/669; 439/638; 381/374; 381/384

(58) Field of Classification Search ..... 439/668, 439/669, 638, 505, 502; 381/77, 118, 120, 381/370, 374, 384–385, 660, 369
See application file for complete search history.

(56) References Cited

U.S. PATENT DOCUMENTS 2,895,119 A * 7/1959 Montgomery, Jr. ..... 439/354
5,024,603 A * 6/1991 Hsieh ..... 439/148
6,203,344 B1 * 3/2001 Ito ..... 439/218
2005/0131560 A1 6/2005 Quat et al.
2006/0252305 A1 11/2006 Le et al.
2007/0053523 A1 * 3/2007 Iuliis et al. ..... 381/77
2007/0141915 A1 * 6/2007 Kim ..... 439/640

FOREIGN PATENT DOCUMENTS

| | | |
|---|---|---|
| CN | 1230803 | 10/1999 |
| CN | 1832631 | 9/2006 |
| DE | 20 2005 016624 | 3/2006 |
| GB | 2241840 | 9/1991 |
| WO | 2005/043950 | 5/2005 |

* cited by examiner

*Primary Examiner*—Xuong M Chung-Trans

(57) ABSTRACT

A multipurpose accessory having a multipurpose connection mechanism is provided. The multipurpose accessory of the present invention includes a case, a multipurpose connector extruded at one side of the case for electrically connecting a multimedia device to the multipurpose accessory, an audio connector extruded near the multipurpose connector for connecting an audio output of the multimedia device to the multipurpose accessory, a first cord extended at an opposite side of the case and connected to the audio connector, a second cord extended at the opposite side of the case and connected to the audio connector and having a USB connector at a distal end, and a pair of earpieces electrically connected to the first and second cords for outputting audio signals in the form of audible sound waves.

15 Claims, 7 Drawing Sheets

MULTIPURPOSE ACCESSORY FOR PORTABLE MULTIMEDIA DEVICE

CROSS-REFERENCE TO RELATED APPLICATION

This application claims priority to and the benefit of Korean Patent Application No. 10-2007-0012421 filed in the Korean Intellectual Property Office on Feb. 2, 2007, the entire contents of which are incorporated herein by reference.

BACKGROUND OF THE INVENTION (a) Field of the Invention

The present invention relates to a multipurpose accessory, and more particularly, to a necklace-type stereo earphone having a multipurpose connection mechanism.

(b) Description of the Related Art

With the advances in sound enhancement and communication technologies, various portable multimedia devices have been developed and have become widespread. Further, such portable multimedia devices are rapidly becoming popular in daily life. This popularity has lead to various user requirements for the multimedia devices. In order to meet the user requirements, the multimedia devices tend to be equipped with attractive and cutting-edge functions. However, the portable multimedia devices have short product cycles relative to their high prices.

The above information disclosed in the background section is only for enhancement of understanding of the background of the invention and therefore it may contain information that does not form the prior art that is already known in this country to a person of ordinary skill in the art.

SUMMARY OF THE INVENTION

The present invention has been made in an effort to solve the above problems, and it is an object of the present invention to provide a multipurpose accessory for a portable multimedia device that is capable of increasing usage duration of the portable multimedia device regardless of its product life cycle by adding supplementary functions to an earphone.

It is another object of the present invention to provide a multipurpose accessory that enables extending the functions of a portable multimedia device regardless of the product life cycle thereof.

In accordance with an aspect of the present invention, the above and other objects are accomplished by a multipurpose accessory. The multipurpose accessory includes: a case; a multipurpose connector extruded at one side of the case for electrically connecting a multimedia device to the multipurpose accessory; an audio connector extruded near the multipurpose connector for connecting an audio output of the multimedia device to the multipurpose accessory; a first cord extended at an opposite side of the case and connected to the audio connector: a second cord extended at the opposite side of the case and connected to the audio connector and having a USB connector at a distal end; and a pair of earpieces electrically connected to the first and second cords for outputting audio signals in the form of audible sound waves.

The multipurpose accessory may further include a USB cover formed at a distal end of the first cord, the USB cover being engaged with the USB connector to form a loop with the first and second cords.

Preferably, the USB connector is provided with a tapered groove and the USB cover is provided with an elastic hook engaged with the groove and a push button for pushing the hook.

The multipurpose accessory may further include a printed circuit board contained in the case, the printed circuit board electrically connecting the audio connector to the earpieces and electrically connecting the multipurpose connector to the USB connector.

The first cord may encapsulate a left audio wire, and the second cord may encapsulate a pair of data wires, a pair of power wires, and a right audio wire connected to corresponding pins of the USB connector.

The multipurpose accessory may still further include a pair of extension cords branched out from the first and second cords and connected to the earpieces at distal ends, respectively, and a pair of dividers for branching out the extension cords from the first and second cords.

Preferably, the multipurpose accessory further includes a cord length adjuster mounted on the first cord.

In accordance with another aspect of the present invention, the above and other objects are accomplished by an earphone having left and right earpieces. The earphone includes: a connection module for connecting the earphone to an external multimedia device; a left cord connecting the left earpiece to the connection module for receiving a left audio signal from the multimedia device; a right cord connecting the right earpiece to the connection module for receiving a right audio signal from the multimedia device; and a first neck cord branched out from the right cord, the first neck cord having a USB connector at a distal end.

The earphone may further include a second neck cord branched out from the left cord and having a holder for holding the USB connector.

The connection module may include an audio connector for electrically connecting the left and right earpieces to left and right audio output pins of the multimedia device.

Preferably, the connection module includes a multipurpose connector having a pair of audio pins for electrically connecting the earpieces to a pair of audio output pins of the multimedia device and a pair of power pins for electrically connecting the USB connector to a pair of charging input pins of the multimedia device. The multipurpose connector may further include a pair of data pins for electrically connecting the USB connector to a pair of data input/output pins of the multimedia device.

Alternatively, the connection module may include a multipurpose connector including a pair of power pins for electrically connecting the USB connector to a pair of charging input pins of the multimedia device.

Preferably, the multipurpose connector may further include a pair of power pins for electrically connecting the USB connector to a pair of data input/output pins of the multimedia device.

BRIEF DESCRIPTION OF THE DRAWINGS

The above and other objects, features, and advantages of the present invention will be more apparent from the following detailed description in conjunction with the accompanying drawings, in which.

DETAILED DESCRIPTION OF EXEMPLARY EMBODIMENTS

Exemplary embodiments of the present invention will now be described in detail with reference to the accompanying drawings. The same reference numbers are used throughout the drawings to refer to the same or like parts. Detailed descriptions of well-known functions and structures incorporated herein may be omitted to avoid obscuring the subject matter of the present invention.

Figure 1:
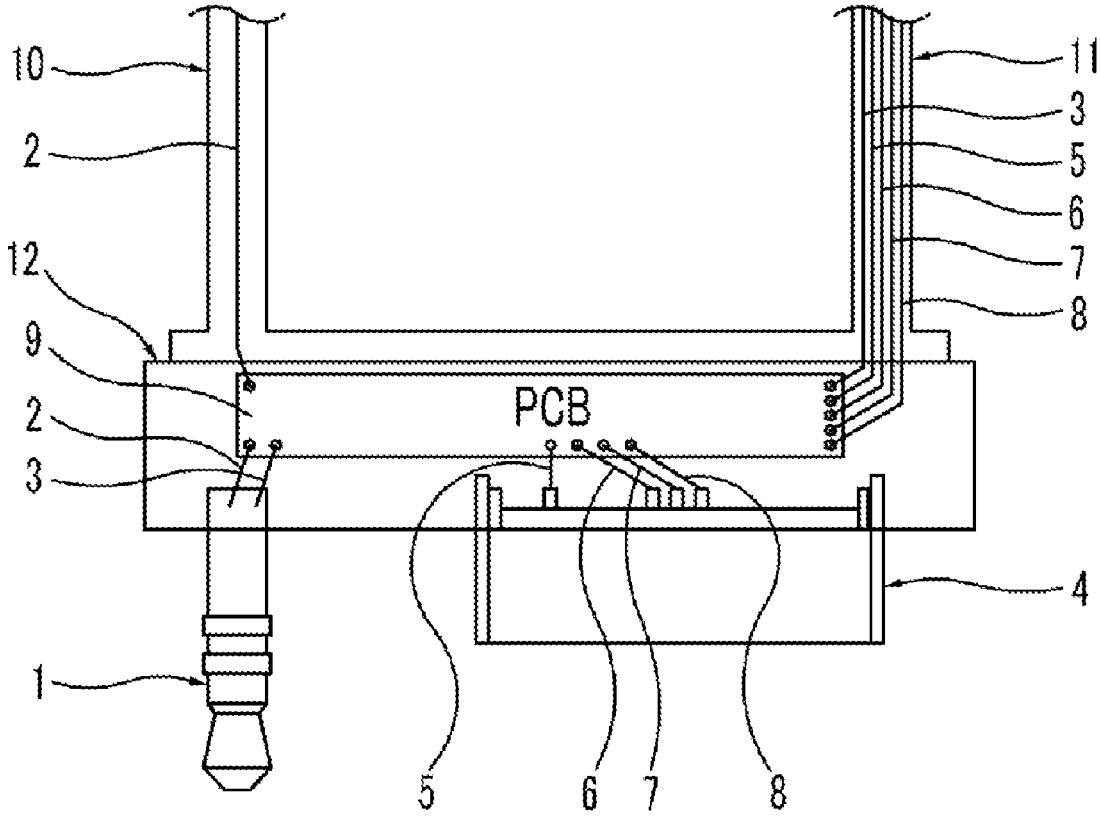
FIG. 1 is a simplified top view illustrating a connection module of a multipurpose accessory according to an exemplary embodiment of the present invention.
Figure 2:
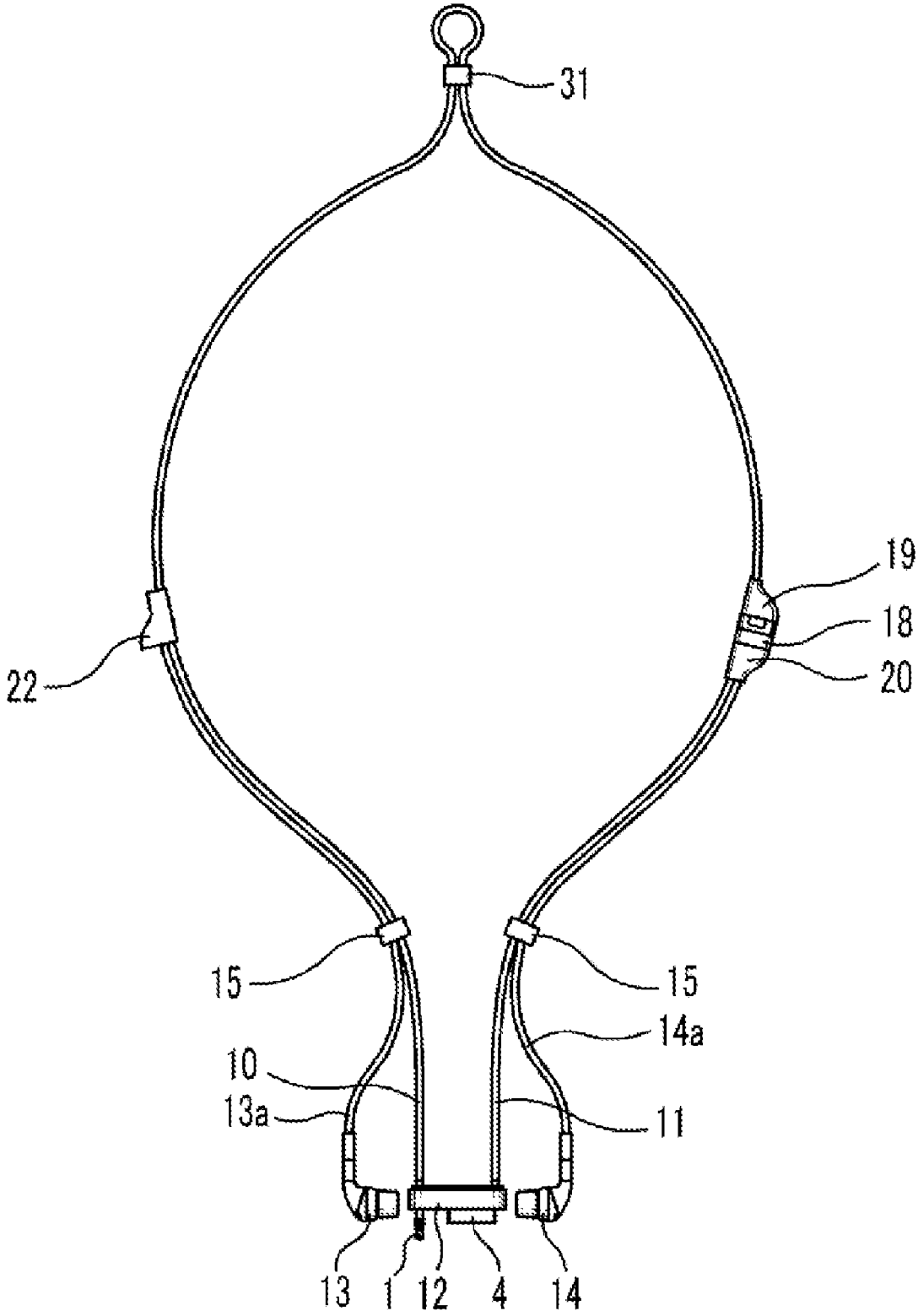
FIG. 2 is a top plan view illustrating a lanyard module according to an exemplary embodiment of the present invention.

FIG. 1 is a simplified top view illustrating a connection module of a multipurpose accessory according to an exemplary embodiment of the present invention, and FIG. 2 is a top plan view illustrating a lanyard module according to an exemplary embodiment of the present invention.

The multipurpose accessory can be implemented as an accessory device that is tightly connected to a portable multimedia device and charged by the multimedia device without an additional power cable, whereby the multipurpose accessory can be designed with a slim and compact contour while maintaining a tight integration of multiple functions.

The multipurpose accessory includes the connection module and the lanyard module.

As shown in FIG. 1, the connection module includes a casing 12, a multi-connector 4 extruded at one side of the casing 12 for connecting the multipurpose accessory to a multimedia device (such as an MP3 player, a portable multimedia player (PMP), and a mobile phone) having a connection slot in which the multi-connector 4 is inserted, an audio connector 1 extruded in the same direction with that of the multi-connector 4 for receiving an audio signal from the multimedia device, an audio cord 10 extruded from the casing 12 at an opposite side of the audio connector 1, and a data cord 11 extracted at an opposite side of the multi-connector 4.

As shown in FIG. 2, the lanyard module includes the audio cord 10 and the data cord 11 extended from the connection module, a USB connector 18 provided at a distal end of the data cord 11, a USB cover 19 provided at a distal end of the audio cord 10 so as to hook on with the USB connector 18, a left earpiece 13 branched out from the audio cord 10 for outputting a left audio signal from the multimedia device, and a right earpiece 14 branched out from the data cord 11 for outputting a right audio signal from the multimedia device.

The USB connector 18 enables a necklace-type earphone to electrically connect the multimedia device to a personal computer (PC) for data communication. The audio cord 10 and the data cord 11 are provided with respective hooks 15 for seating the left and right earpieces 13 and 14.

Figure 3A:
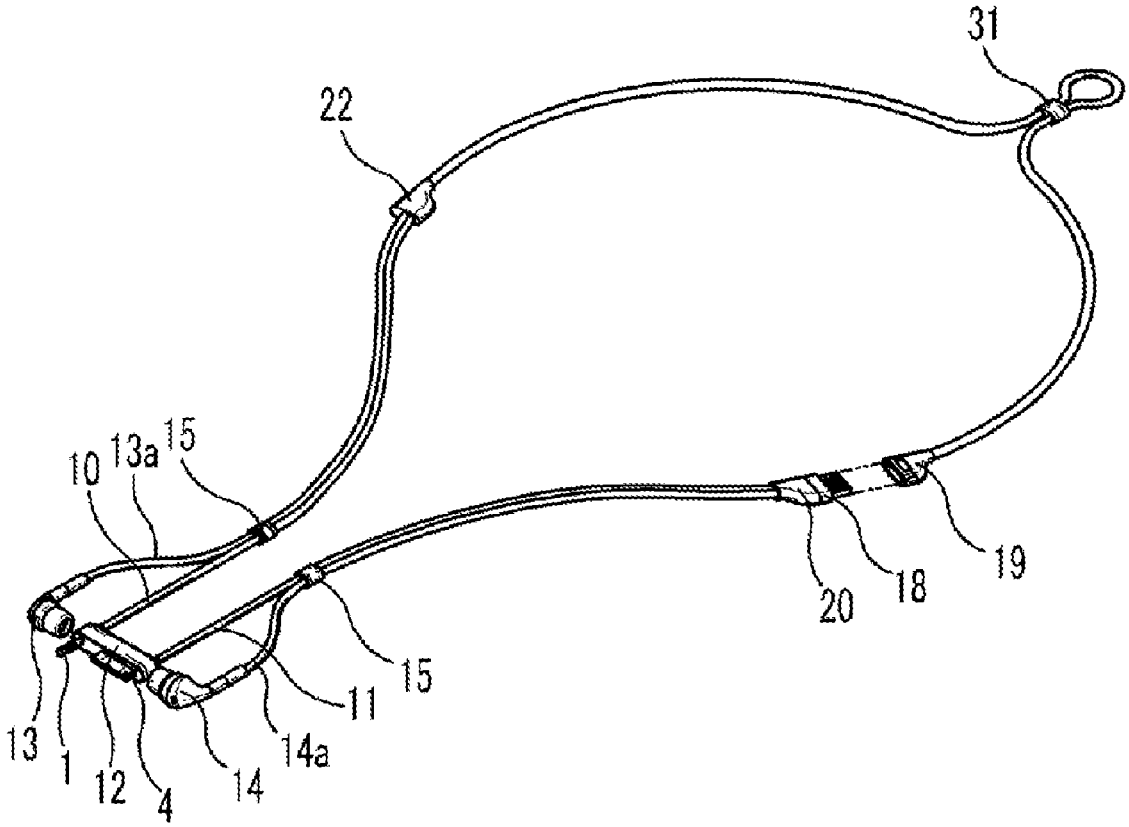
FIG. 3*a* is a perspective view illustrating the lanyard module of FIG. 2.
Figure 3B:
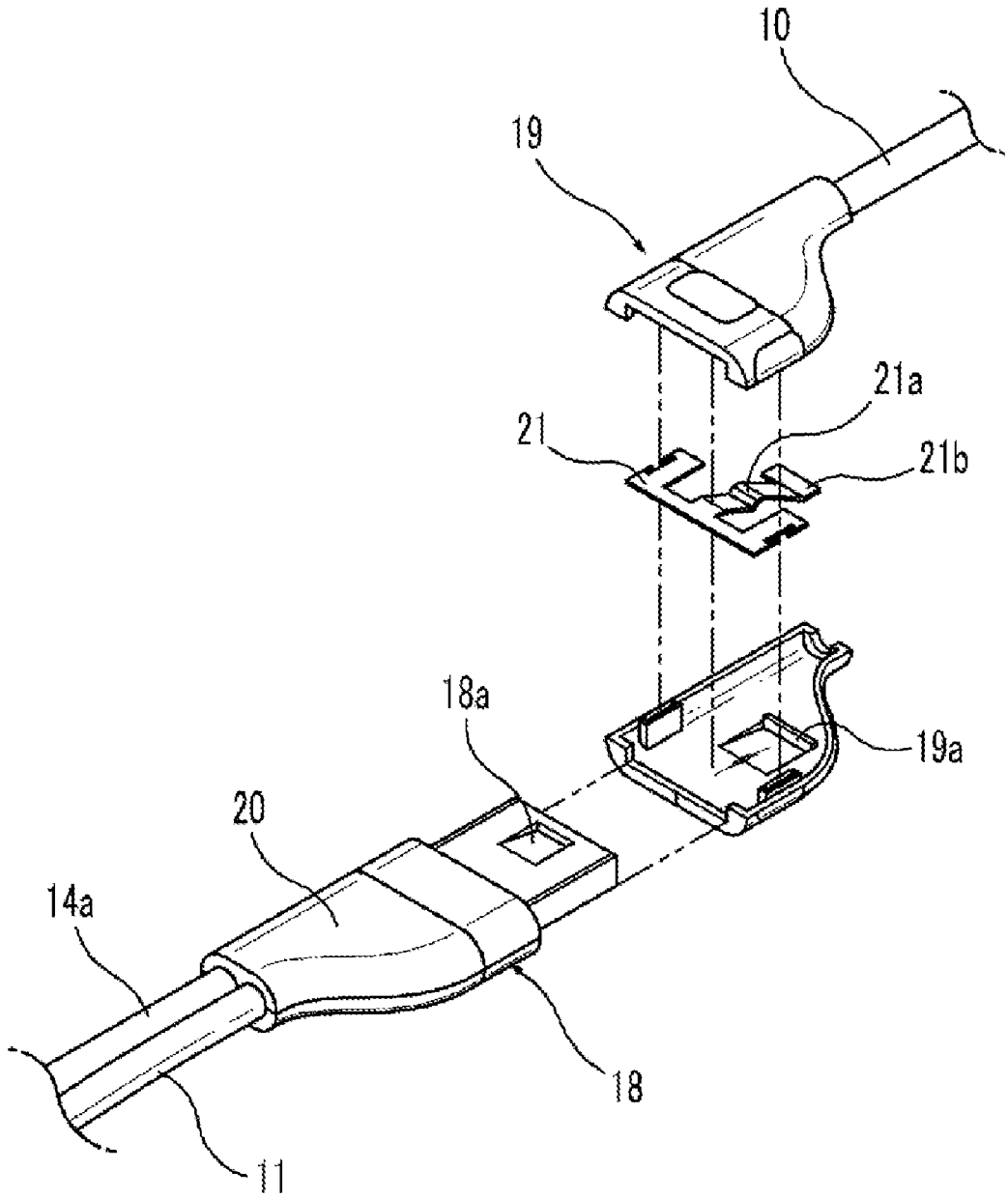
FIG. 3*b* is a perspective view illustrating the USB connector of FIG. 2.

FIGS. 3*a* and 3*b* are perspective views illustrating the lanyard module of FIG. 2.

Referring to FIG. 3*a* and 3*b*, the USB connector 18 is provided with a groove 18*a* tapered at a predetermined angle and the USB cover 19 is provided with a hook 21 such that the hook 21 can be elastically engaged with the groove 18*a*. The USB cover 19 is provided with a push button 19*a* for disengaging the hook 21 from the groove 18*a*.

That is, the hook 21 is made in the form of a plate spring having a protrusion 21*a* such that the protrusion 21*a* is inserted into the groove 18*a* by the elastic force of the plate spring, and the engagement is released by pushing a push part 21*b* of the hook 21 by the push button 19*a*.

The connection module includes a printed circuit board (PCB) 9 having circuitry establishing a left audio link 2 connecting a left audio pin of the audio connector 1 to a left audio wire encapsulated in the audio cord 10, a right audio link 3 connecting a right audio pin of the audio connector 1 to a right audio wire encapsulated in the data cord 11, a pair of data links 6 and 7 connecting the data pins of the multi-connector 4 to corresponding data pins of the USB connector 18 through data wires encapsulated in the data cord 11, and a pair of power links 5 and 8 connecting the power pins of the multi-connector 4 to corresponding power pins of the USB connector 18 through positive and negative power wires encapsulated in the data cord 11.

Accordingly, when the multipurpose accessory is connected to the multimedia device, the left audio signal is delivered to the left earpiece 13 via the left audio pin of the audio connector 1, the PCB 9, and the left audio wire of the audio cord 10, and the right audio signal is delivered to the right earpiece 14 via the right audio pin of the audio connector 1, the PCB 9, and the right audio wire of the data cord 11.

The left and right audio links 2 and 3 are extended to the left and right earpieces 13 and 14 via respective extension cords 13*a* and 14*a* branched out from the audio cord 10 and the data cord 11, respectively, the extension cords 13*a* and 14*a* being branched out from the audio cord 10 and the data cord 11 by means of dividers 22 and 20, respectively.

The audio cord 10 can be adjusted with a cord length adjusting means 31 that slides along the audio cord 10.

As described above, the multipurpose accessory of the present invention is provided with a USB connector 18 and a multi-connector 4 for connecting a PC and a multimedia device, as well as the audio connector 1. The USB connector 18 and the multi-connector 4 establish a data link and a power link between the multimedia device and the PC such that the multimedia device can perform data communication with the PC through the data link and can be charged through the power link without an additional data cable or power cable.

The multipurpose connector can be one of a 30 pin connector, a 24 pin connector, a 22 pin connector, and a 10 pin connector. Also, the multi-connector 4 can be implemented to be coupled with various connector converters for increasing the connection capability of the multipurpose accessory.

Further, the multipurpose accessory is provided with the audio cord 10 and data cord 11 that are coupled with each other at their distal ends while its audio connector and multipurpose connector are connected to the portable multimedia device such that the multipurpose accessory can be worn around a user's neck to carry the portable multimedia device.

Figure 4:
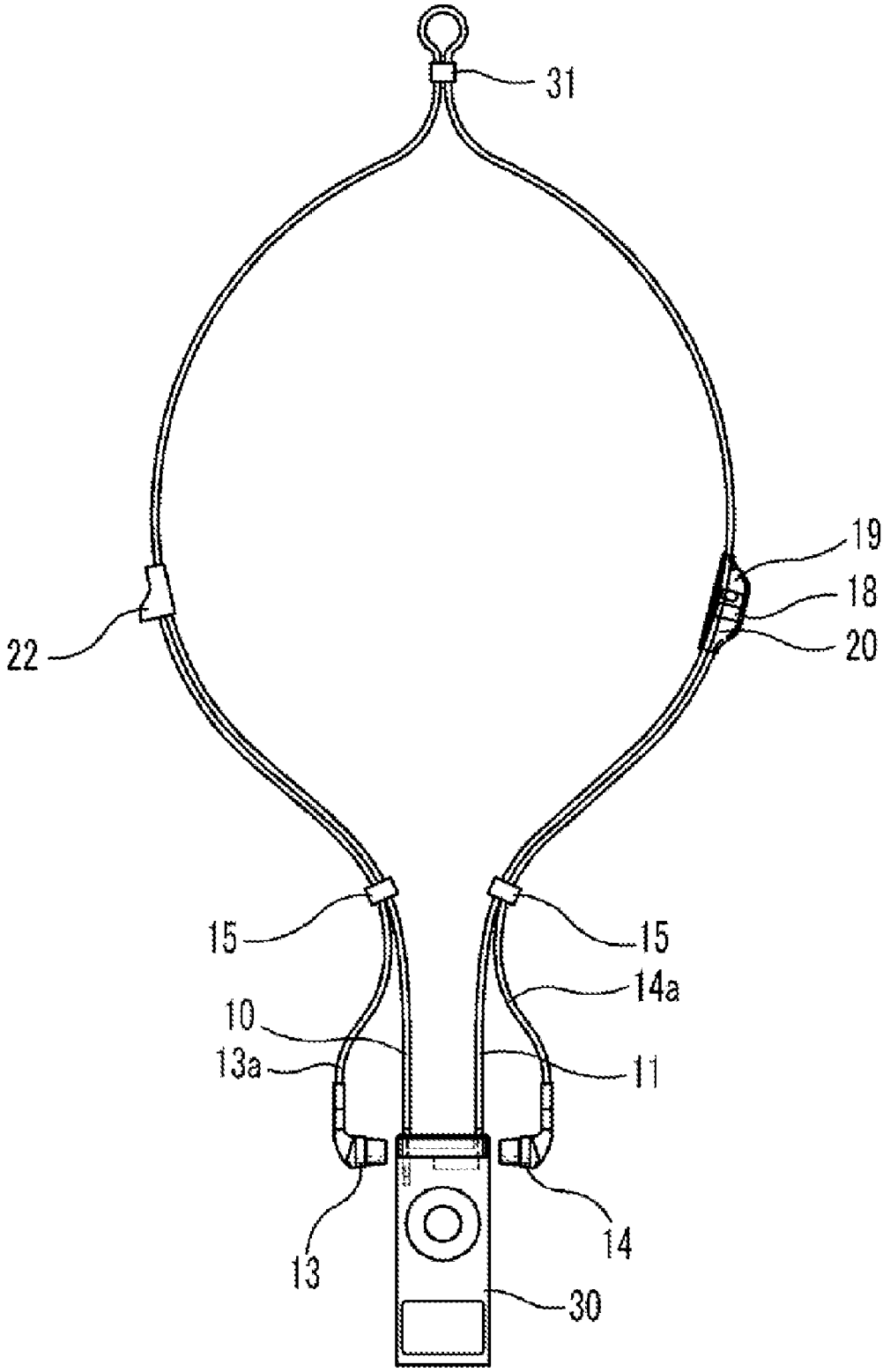
FIG. 4 is a top plan view illustrating a multipurpose accessory connected with a portable multimedia device, according to an exemplary embodiment of the present invention.

FIG. 4 is a top plan view illustrating the multipurpose accessory connected with a portable multimedia device, according to an exemplary embodiment of the present invention.

As shown in FIG. 4, the multipurpose accessory is connected to the portable multimedia device by means of the connection module, and the USB connector 18 is coupled with the USB cover 19. In this case, the left audio pin of the audio connector 1 is connected to the left earpiece 13 through the left audio link 2 and the right audio pin of the audio connector 1 is connected to the right earpiece 14 such that the audio signals from a portable multimedia device 30 are output through the left and right earpieces 13 and 14 in the form of audible sound waves.

Figure 5:
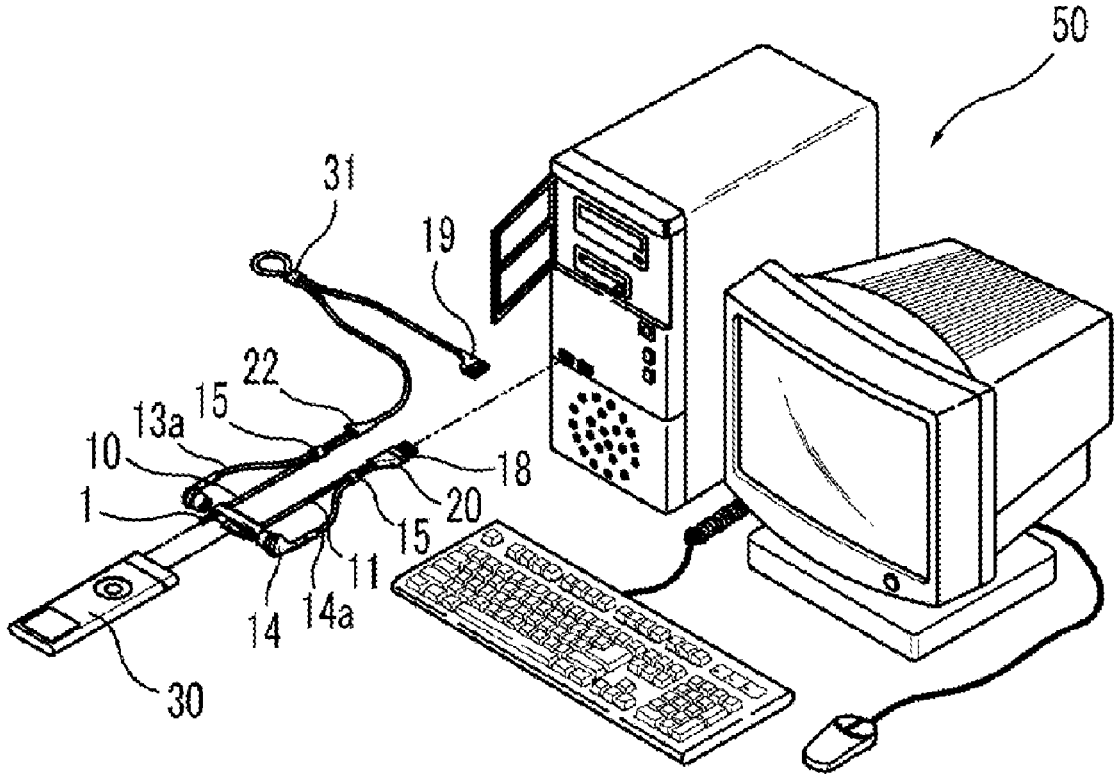
FIG. 5 is a perspective view illustrating a multipurpose accessory connected to a PC and a portable multimedia device, according to an embodiment of the present invention.

FIG. 5 is a top plan view illustrating the multipurpose accessory connected to a PC and a portable multimedia device, according to an embodiment of the present invention.

As shown in FIG. 5, the USB connector 18 and the USB cover 19 are disengaged. In order to charge the portable multimedia device 30 or to bridge data between the PC 50 and the portable multimedia device 30, the USB connector 18 provided at the end of the data cord 11 is inserted into a USB slot of the PC such that the data pins of the USB connector 18 are connected to the corresponding data pins of the multipurpose connector through the data wires encapsulated in the data cord 11 resulting in establishment of data links 6 and 7, and the power pins of the USB connector 18 are connected to the corresponding power pins of the multi-connector 4 through the five wires encapsulated in the data cord 11. The portable multimedia device 30 can be an MP3 player, a PMP, a digital camera, a mobile phone, or other audio/video devices, and the power charging and data communication can be performed at the same time. Preferably, the USB connector 18 and the USB cover 19 are provided with a tapered groove 18*a*, an elastic hook 21, and a push button 19*a* for preventing unwanted disengagement when the USB connector 18 and the USB cover 19 are engaged with each other. The audio cord 10 is provided with a cord length adjusting means 31 that slides along the audio cord 10 such that the length of the audio cord 10 can be adjusted by sliding the length adjusting means 31.

Figure 6:
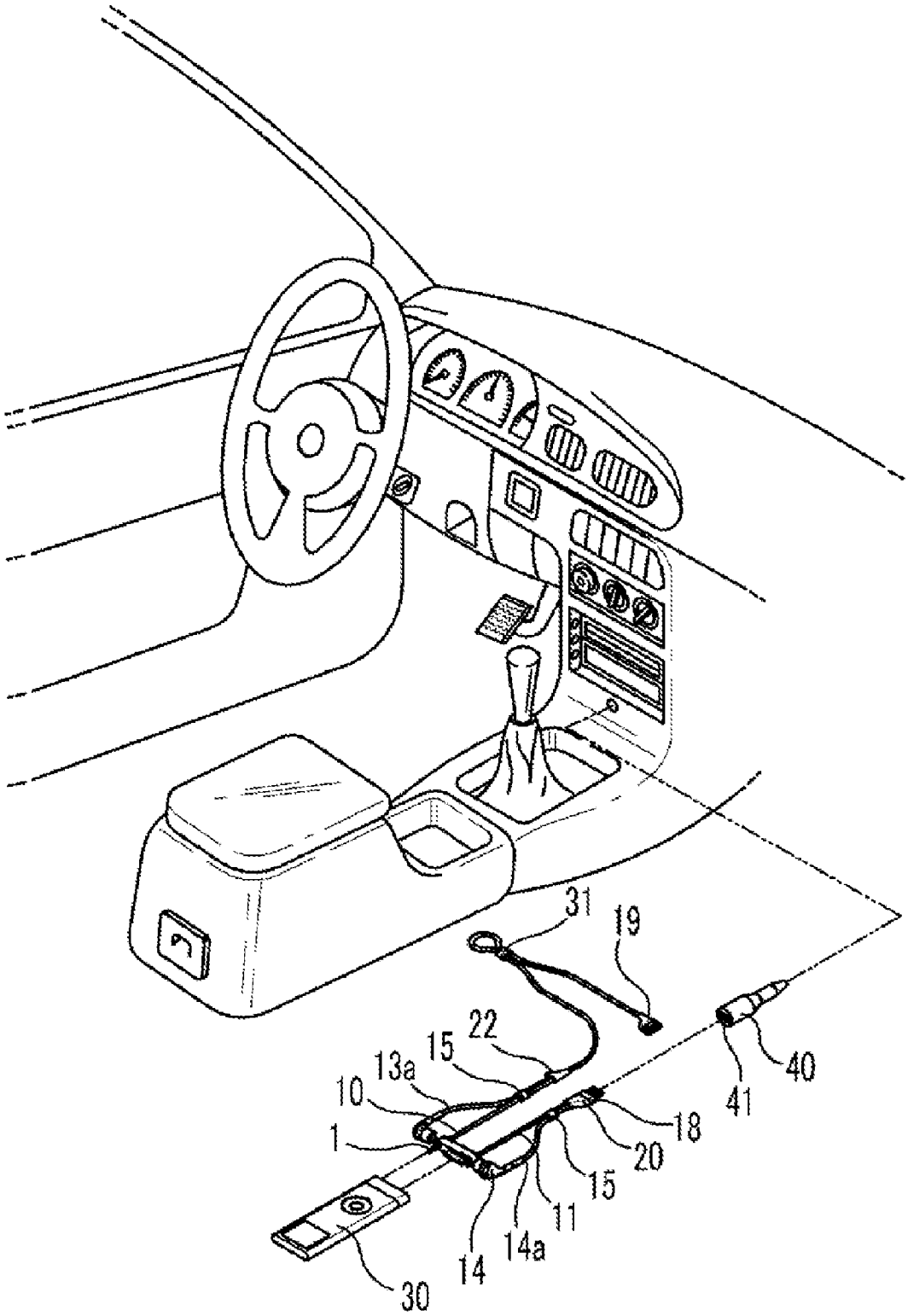
FIG. 6 is a perspective view illustrating a multipurpose accessory connected to a car charger, according to an exemplary embodiment of the present invention.

FIG. 6 is a perspective view illustrating the multipurpose accessory connected to a car charger, according to an exemplary embodiment of the present invention.

As shown in FIG. 6, the multipurpose accessory can be connected to a car charger 40 by coupling the USB connector 18 with a USB slot 41 provided at a distal end of the car charger 40 such that a portable multimedia device 30 connected to the multipurpose accessory by means of the connection module can be charged. That is, the multipurpose accessory according to an exemplary embodiment of the present invention can be used as a power cord for in-car charging a portable multimedia device 30 connected to the multipurpose accessory.

Although exemplary embodiments of the present invention are described in detail hereinabove, it should be clearly understood that many variations and/or modifications of the basic inventive concepts herein taught which may appear to those skilled in the present art will still fall within the spirit and scope of the present invention, as defined in the appended claims.

As described above, the multipurpose accessory of the present invention can be used as a power cord for charging a portable multimedia device and for bridging data between a PC and a portable device, as well as for listening to music.

By adding supplementary functions, such as a power cord and data cord functions to an earphone, the multipurpose accessory of the present invention is capable of increasing usage duration of a portable multimedia device regardless of its product life cycle, thereby saving money for purchasing newly issued portable multimedia devices and increasing utilization of the portable multimedia device.

What is claimed is:

1. An earphone having left and right earpieces, comprising:

a connection module for connecting the earphone to an external multimedia device;

a left cord connecting the left earpiece to the connection module for receiving a left audio signal from the multimedia device;

a right cord connecting the right earpiece to the connection module for receiving a right audio signal from the multimedia device;

a first neck cord branched out from the right cord;

a second neck cord branched out from the left cord, wherein the second neck cord is incapable of transmitting signals from the connection module, and wherein the second neck cord includes a USB cover positioned at a distal end thereof; and a USB connector connected to the right cord and transmitting data between a computer and the right cord, wherein the data transmission between the computer and the multimedia device is performed via the USB connector, the right cord and the connection module; and wherein the left cord and right cord extend from a selected side of the connection module in a substantially parallel fashion.

2. The earphone of claim 1, wherein the connection module comprises an audio connector for electrically connecting the left and right earpieces to left and right audio output pins of the multimedia device.

3. The earphone of claim 2, wherein the connection module comprises a multipurpose connector comprising a pair of audio pins for electrically connecting the earpieces to a pair of audio output pins of the multimedia device and a pair of power pins for electrically connecting the USB connector to a pair of charging input pins of the multimedia device.

4. The earphone of claim 3, wherein the multipurpose connector further comprises a pair of data pins for electrically connecting the USB connector to a pair of data input/output pins of the multimedia device.

5. The earphone of claim 3, wherein the connection module comprises a multipurpose connector comprising a pair of power pins for electrically connecting the USB connector to a pair of charging input pins of the multimedia device.

6. The earphone of claim 5, wherein the multipurpose connector further comprises a pair of power pins for electrically connecting the USB connector to a pair of data input/output pins of the multimedia device.

7. A multipurpose accessory comprising:

a case that includes a multipurpose connector and an audio connector;

a first cord that extends from the case to a first divider, and that includes a first audio conductor that is electronically coupled to the audio connector, and a data conductor that is electronically coupled to the multipurpose connector;

a first cord first branch that extends from the first divider to a first earpiece, wherein the first audio conductor further extends from the first divider to the first earpiece;

a first cord second branch that extends from the first divider to a USB connector, wherein the data conductor further extends from the first divider to the USB connector;

a second cord that extends from the case to a second divider, and that includes a second audio conductor that is electronically coupled to the audio connector, wherein the second cord does not include any electrical conductors that are electronically coupled to the multipurpose connector;

a second cord first branch that extends from the second divider to a second earpiece, wherein the second audio conductor further extends from the second divider to the second earpiece; and a second cord second branch that extends from the second divider to a USB cover, wherein the second cord second branch is configured to transmit neither audio signals nor data signals therethrough, and wherein the USB cover is configured to neither transmit nor receive data signals.

8. The multipurpose accessory of claim 7, wherein the USB cover is configured to receive the USB connector.

9. The multipurpose accessory of claim 7, wherein the USB connector includes a tapered groove, and the USB cover includes (a) an elastic hook configured to engage the tapered groove and (b) a push button configured to push the elastic hook.

10. The multipurpose accessory of claim 7, further comprising a printed circuit board positioned within the case, wherein (a) the first and second audio conductors are electronically coupled to the audio connector via the printed circuit board, (b) the data conductor is electronically coupled to the multipurpose connector via the printed circuit board.

11. The multipurpose accessory of claim 7, wherein the data conductor includes at least two data wires and at least two power wires.

12. The multipurpose accessory of claim 7, further comprising:

a first hook that is configured to couple the first cord to the first cord first branch; and a second hook that is configured to couple the second cord to the second cord first branch.

13. The multipurpose accessory of claim 7, further comprising a cord length adjuster mounted on the second cord second branch.

14. The multipurpose accessory of claim 7, wherein the multipurpose connector is selected from the group consisting of: a 30-pin connector, a 24-pin connector, a 22-pin connector, and a 10-pin connector.

15. The multipurpose accessory of claim 7, wherein the first cord and the second cord extend from a single side of the case, and wherein the first cord and the second cord are substantially parallel to each other where they extend from the case.

* * * * *